US005979646A

United States Patent [19]

Strachan

[11] Patent Number: 5,979,646

[45] Date of Patent: Nov. 9, 1999

[54] SPECIALIZED TRAY SYSTEM

[76] Inventor: Robert C. Strachan, 1364 46th Avenue, Trail, British Columbia, Canada, V1R 1S2

[21] Appl. No.: 09/169,820

[22] Filed: Oct. 9, 1998

[51] Int. Cl.[6] ..... B65D 77/00

[52] U.S. Cl. ..... 206/217; 206/815; 206/562; 220/738; 220/903

[58] Field of Search ..... 206/217, 576, 206/815, 427, 431, 562, 564, 443, 496, 303; 248/176.1, 146; 220/915.1, 738, 739, 737, 903, 507

[56] References Cited

U.S. PATENT DOCUMENTS

| | | | |
|---|---|---|---|
| 2,465,324 | 3/1949 | De Mian | 206/562 |
| 2,547,716 | 4/1951 | Murphy | 220/507 |
| 2,728,484 | 12/1955 | Farrington | 206/564 |
| 3,005,584 | 10/1961 | Coe | 206/562 |
| 3,848,766 | 11/1974 | Ganti et al. | 220/507 |
| 4,018,904 | 4/1977 | Muraoka | 426/115 |
| 4,824,059 | 4/1989 | Butler | 248/176 |
| 4,890,807 | 1/1990 | Desjardins | 248/146 |
| 4,998,696 | 3/1991 | Desjardins | 248/146 |
| 5,052,552 | 10/1991 | Maroszek | 206/174 |
| 5,062,531 | 11/1991 | Coy | 206/564 |
| 5,671,846 | 9/1997 | Frank | 206/541 |

*Primary Examiner*—Paul T. Sewell
*Assistant Examiner*—Nhan T. Lam

[57] ABSTRACT

A specialized tray system including a tray, the tray having front and rear walls parallel with each other and side walls parallel with respect to each other, an imperforate bottom coupling the lower ends of the walls and a top coupling upper ends of the walls. Six plastic removable supports are positionable within the apertures and adapted to receive smaller glasses for transportation by the specialized tray. The height of the trays being such that the lower surface of the flange will rest on the upper surface of the top while the lower surface of the insert will rest on the upper surface of the bottom. Each support having a rigid plastic exterior and flange with a foam plastic interior for gripping a smaller glass. A large opening is formed in the front wall adapted to receive associated objects such as straws, condiments and the like.

5 Claims, 2 Drawing Sheets

SPECIALIZED TRAY SYSTEM

BACKGROUND OF THE INVENTION

1. Field of the Invention

The present invention relates to a specialized tray system and more particularly pertains to supporting and transporting up to six glasses of beverage and associated objects such as straws.

2. Description of the Prior Art

The use of trays is known in the prior art. More specifically, trays heretofore devised and utilized for the purpose of supporting and transporting objects of known designs and configurations are known to consist basically of familiar, expected, and obvious structural configurations, notwithstanding the myriad of designs encompassed by the crowded prior art which has been developed for the fulfillment of countless objectives and requirements.

By way of example, International Application Number PCT/US89/03737 to Rehrig-Pacific Company discloses a low depth, nestable tray for fluid containers. U.S. Pat. No. 3,938,688 to Ryan discloses a covered serving tray. U.S. Pat. No. 3,908,877 to Kosisky discloses a Holder and Server for Beverage Cups and the Like. U.S. Pat. No. 2,878,932 to Matire, Jr. discloses a Food Tray. European Patent Application Number 92203127.3 to International Container Systems, Inc. discloses a Nestable Tray with Laterally Stable Side Walls in Nested Position. U.S. Pat. No. 3,942,671 to Florian discloses a Carry-Out Tray. Lastly, U.S. Pat. No. 3,295,737 to Page et al. discloses a Tray.

While these devices fulfill their respective, particular objectives and requirements, the aforementioned patents do not describe specialized tray system as described herein.

In this respect, the specialized tray system according to the present invention substantially departs from the conventional concepts and designs of the prior art, and in doing so provides an apparatus primarily developed for the purpose of supporting and transporting up to six glasses of beverage and associated objects such as straws.

Therefore, it can be appreciated that there exists a continuing need for a new and improved specialized tray system which can be used for supporting and transporting up to six glasses of beverage and associated objects such as straws. In this regard, the present invention substantially fulfills this need.

SUMMARY OF THE INVENTION

In view of the foregoing disadvantages inherent in the known types of trays now present in the prior art, the present invention provides an improved specialized tray system. As such, the general purpose of the present invention, which will be described subsequently in greater detail, is to provide a new and improved specialized tray system and method which has all the advantages of the prior art and none of the disadvantages.

To attain this, the present invention essentially comprises a new and improved specialized tray system for supporting and transporting up to six glasses of beverage and associated objects such as straws comprising, in combination, a tray in a generally rectilinear configuration. The tray having rectangular front and rear walls parallel with each other and side walls parallel with respect to each other. An imperforate bottom is provided in a rectangular configuration coupling the lower ends of the walls and a top in a rectangular configuration coupling upper ends of the walls. The top being of a size and shape essentially equal to that of the bottom with six circular apertures symmetrically spaced therein in three rows and two columns each of the apertures being about 3 inches in diameter. The top also being spaced from the bottom by about 3 inches to allow one or more generally frusto-conical glasses to be placed in the apertures with the bottoms of the glasses resting on the upper surface of the bottom. A slot is formed in each side wall having parallel upper and lower edges and rounded end edges. The slots being located closer to the top than the bottom and extending from a center position on the wall about 8 inches in length and 1½ inches in height. The slots being adapted to function together as handles for carrying the tray. Six plastic removable supports are positionable within the apertures and are adapted to receive smaller glasses for transportation by the specialized tray. Each of the inserts being in a generally frusto-conical configuration with a flat lower end and an upper open end and an associated annular flange around the upper end positionable upon the area of the tray surrounding an aperture, the height of the trays being such that the lower surface of the flange will rest on the upper surface of the top while the lower surface of the insert will rest on the upper surface of the bottom. Each support having a rigid plastic exterior and flange with a foam plastic interior for gripping a smaller glass. A large rectangular opening is formed in the front wall adapted to receive associated objects such as straws, condiments and the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved specialized tray system which has all of the advantages of the prior art trays and none of the disadvantages.

It is another object of the present invention to provide a new and improved specialized tray system which may be easily and efficiently manufactured and marketed.

It is further object of the present invention to provide a new and improved specialized tray system which is of durable and reliable constructions.

An even further object of the present invention is to provide a new and improved specialized tray system which is susceptible of a low cost of manufacture with regard to both materials and labor, and which accordingly is then susceptible of low prices of sale to the consuming public, thereby making such specialized tray system economically available to the buying public.

Even still another object of the present invention is to provide a specialized tray system for supporting and transporting up to six glasses of beverage and associated objects such as straws.

Lastly, it is an object of the present invention to provide a new and improved specialized tray system including a tray, the tray having front and rear walls parallel with each other and side walls parallel with respect to each other, an imperforate bottom coupling the lower ends of the walls and a top coupling upper ends of the walls. Six plastic removable supports are positionable within the apertures and adapted to receive smaller glasses for transportation by the specialized tray. The height of the trays being such that the lower surface of the flange will rest on the upper surface of the top while the lower surface of the insert will rest on the upper surface of the bottom. Each support having a rigid plastic exterior and flange with a foam plastic interior for gripping a smaller glass. A large opening is formed in the front wall adapted to receive associated objects such as straws, condiments and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
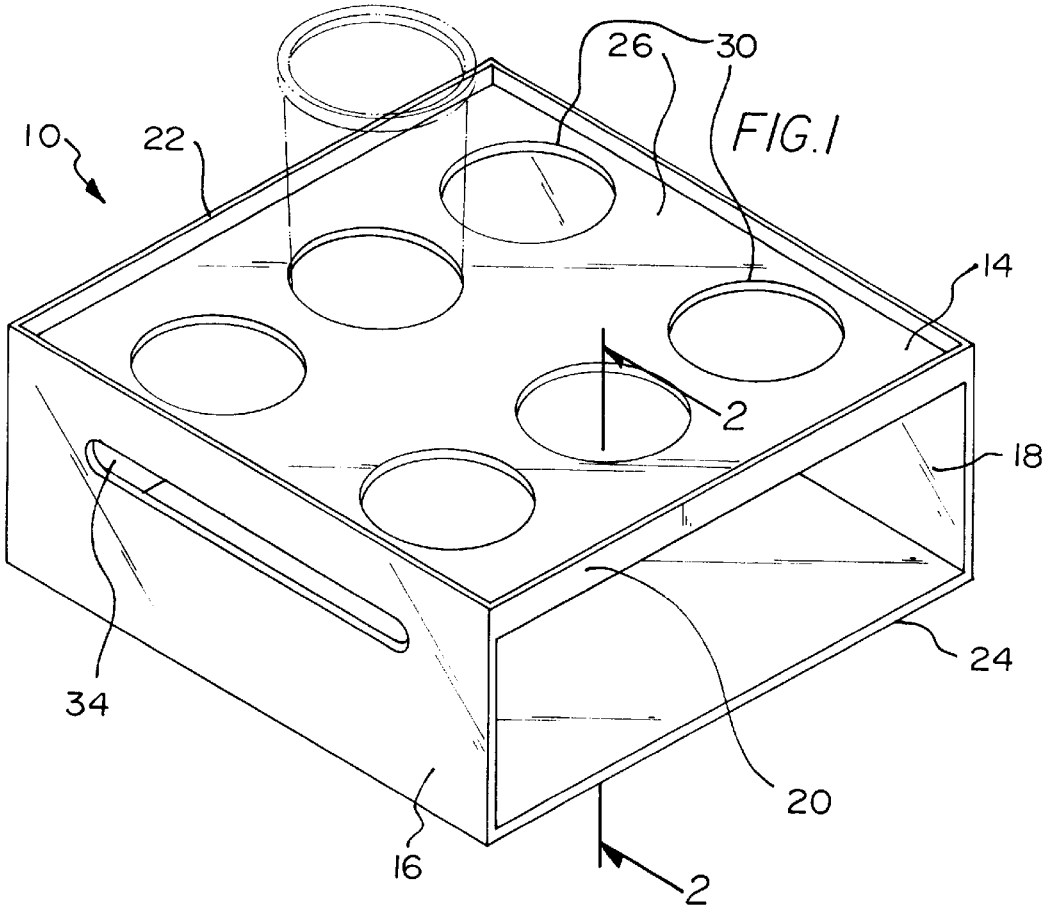
FIG. 1 is a perspective view of the preferred embodiment of the specialized tray system constructed in accordance with the principles of the present invention.
Figure 2:
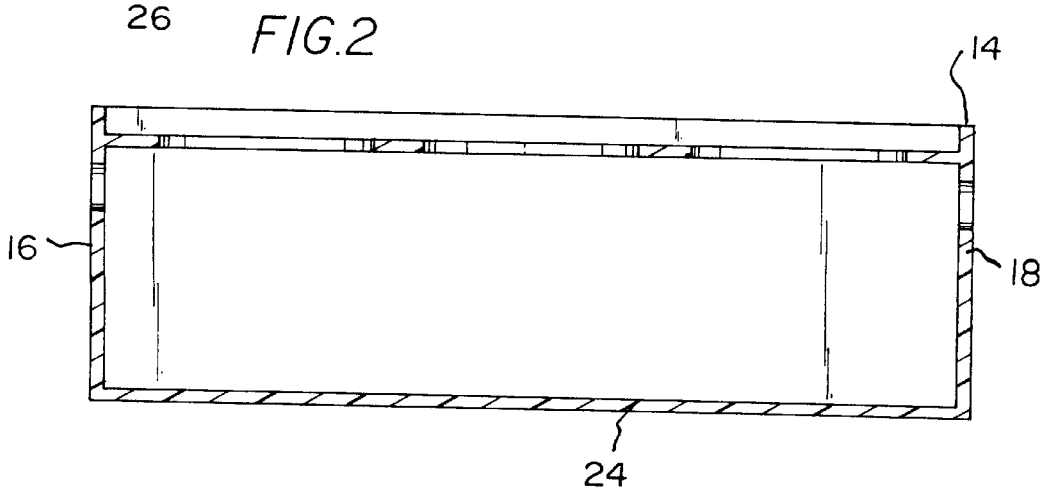
FIG. 2 is a cross-sectional view taken along line 2—2 of FIG. 1.
Figure 3:
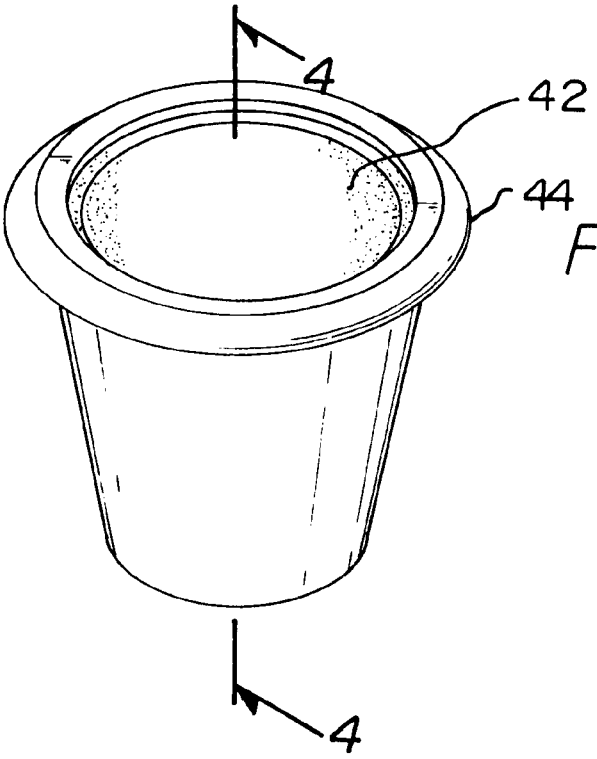
FIG. 3 is a front elevational view of an insert adapted for use in association with the tray of the prior Figures.
Figure 4:
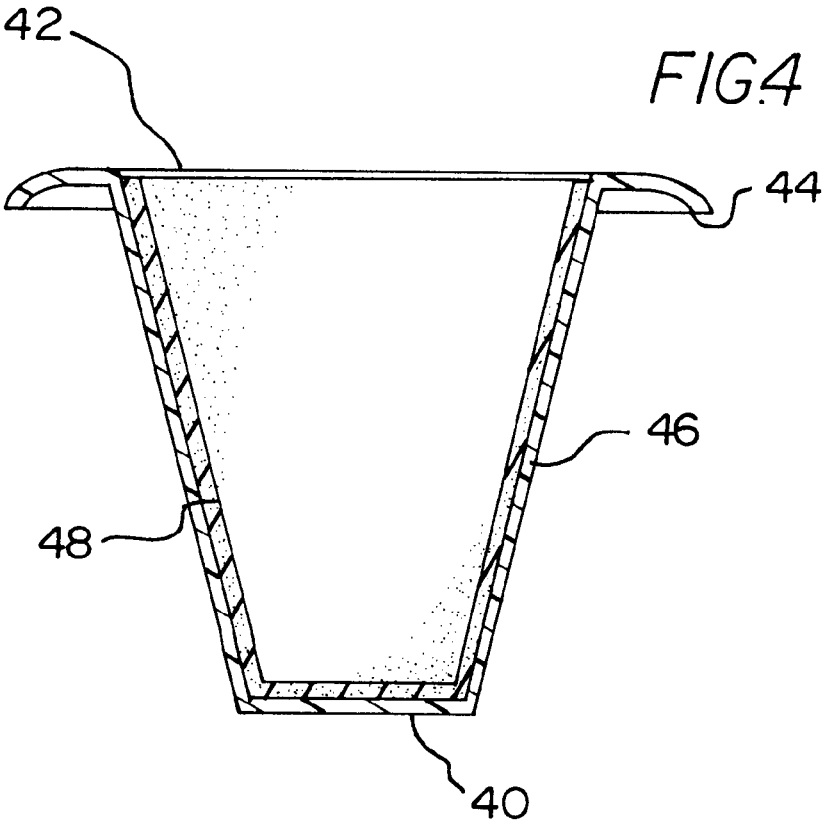
FIG. 4 is a cross-sectional view taken along line 4—4 of FIG. 3.

With reference now to the drawings, and in particular to FIG. 1 thereof, the preferred embodiment of the new and improved specialized tray system embodying the principles and concepts of the present invention and generally designated by the reference numeral 10 will be described.

The present invention, the specialized tray system 10 is comprised of a plurality of components. Such components in their broadest context include a tray, a slot, six plastic removable supports, an opening. Such components are individually configured and correlated with respect to each other so as to attain the desired objective.

The present invention, the new and improved specialized tray system 10 for supporting and transporting up to six glasses of beverage and associated objects such as straws comprises, in combination, a tray 14 in a generally rectilinear configuration, the tray having rectangular front and rear walls 16, 18 parallel with each other and side walls 20, 22 parallel with respect to each other. An imperforate bottom 24 is in a rectangular configuration coupling the lower ends of the walls and a top 26 in a rectangular configuration coupling upper ends of the walls.

The top is of a size and shape essentially equal to that of the bottom with six circular apertures 30 symmetrically spaced therein in three rows and two columns each of the apertures being about 3 inches in diameter. The top is spaced from the bottom by about 3 inches to allow one or more generally frusto-conical glasses to be placed in the apertures with the bottoms of the glasses resting on the upper surface of the bottom.

A slot 34 is formed in each side wall having parallel upper and lower edges and rounded end edges. The slots being located closer to the top than the bottom and extending from a center position on the wall about 8 inches in length and 1½ inches in height. The slots are adapted to function together as handles for carrying the tray.

Also provided are six plastic removable supports 38 positionable within the apertures and adapted to receive smaller glasses for transportation by the specialized tray. Each of the inserts being in a generally frusto-conical configuration with a flat lower end 40 and an upper open end 42 and an associated annular flange 44 around the upper end positionable upon the area of the tray surrounding an aperture. The height of the trays being such that the lower surface of the flange will rest on the upper surface of the top while the lower surface of the insert will rest on the upper surface of the bottom. Each support having a rigid plastic exterior 46 and flange with a foam plastic interior 48 for gripping a smaller glass.

Lastly provided is a large rectangular opening 52 formed in the front wall adapted to receive associated objects such as straws, condiments and the like.

The tray of the present invention is a specialized tray for securely holding and carrying up to six carry-out cups. The system is made from plastic and features a box-like shape with six holes in the upper layer. The holes are 4" in diameter, large enough to accommodate the biggest cups offered for carryout beverages. One side of eh holder tray is left open, to allow straws or other items to be carried inside, and also to facilitate cleaning of the device. Handles are inset into the sides of the try to aid carrying and upper surface has a surrounding rim to help contain spills.

The tray of the present invention is ideal for sporting events, camping, and days at the beach and puts an end to messy and unnecessary beverage spills.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved specialized tray system for supporting and transporting up to six glasses of beverage and associated objects such as straws comprising, in combination:

a tray in a generally rectilinear configuration, the tray having rectangular front and rear walls parallel with each other and side walls parallel with respect to each other, the walls having upper ends and lower ends with an imperforate bottom in a rectangular configuration coupling the lower ends of the walls and a top in a rectangular configuration coupling upper ends of the walls, the bottom having an upper surface and a lower surface;

the top being of a size and shape essentially equal to that of the bottom with six circular apertures symmetrically spaced therein in three rows and two columns each of the apertures being about 3 inches in diameter, the top being spaced from the bottom by about 3 inches to allow one or more generally frusto-conical glasses with tops and bottoms to be placed in the apertures with the bottoms of the glasses resting on the upper surface of the bottom;

a slot formed in each side wall having parallel upper and lower edges and rounded end edges, the slots being located closer to the top than the bottom and extending from a center position on the wall about 8 inches in length and 1½ inches in height, the slots adapted to function together as handles for carrying the tray;

six plastic removable supports positionable within the apertures and adapted to receive smaller glasses for transportation by the specialized tray, each of the inserts being in a generally frusto-conical configuration with a flat lower end and an upper open end and an associated annular flange around the upper end positionable upon the area of the tray surrounding an aperture, each flange having a lower surface, the height of the trays being such that the lower surface of the flange will rest on the upper surface of the top while the lower end of the insert will rest on the upper surface of the bottom, each support having a rigid plastic exterior and flange, each support having a foam plastic interior for gripping a smaller glass; and a large rectangular opening formed in the front wall adapted to receive associated objects such as straws, condiments and the like.

2. A specialized tray system comprising:

a tray, the tray having front and rear walls parallel with each other and side walls parallel with respect to each other, an imperforate bottom coupling the lower ends of the walls and a top coupling upper ends of the walls;

six plastic removable supports positionable within the apertures and adapted to receive smaller glasses for transportation by the specialized tray, each of the inserts being in a generally frusto-conical configuration with a flat lower end and an upper open end and an associated annular flange around the upper end positionable upon the area of the tray surrounding an aperture, each flange having a lower surface, the height of the trays being such that the lower surface of the flange will rest on an upper surface of the top while the lower end of the insert will rest on the upper surface of the bottom, each support having a rigid plastic exterior and flange, each support having a foam plastic interior for gripping a smaller glass; and a large opening is formed in the front wall adapted to receive associated objects such as straws, condiments and the like.

3. The system as set forth in claim 2 wherein the top is of a size and shape essentially equal to that of the bottom with six circular apertures symmetrically spaced therein in three rows and two columns each of the apertures being about 3 inches in diameter, the top being spaced from the bottom by about 3 inches to allow one or more generally frusto-conical glasses with bottoms to be placed in the apertures with the bottoms of the glasses resting on the upper surface of the bottom.

4. The system as set forth in claim 2 wherein a slot is formed in each side wall, having parallel upper and lower edges and rounded end edges, the slots being located closer to the top than the bottom and extending from a center position on the wall about 8 inches in length and 1½ inches in height, the slots adapted to function together as handles for carrying the tray.

5. The system as set forth in claim 2 wherein each of the inserts are in a generally frusto-conical configuration with a flat lower end and an upper open end and an associated annular flange around the upper end positionable upon the area of the tray surrounding an aperture.

* * * * *